US007886874B2

(12) United States Patent
Murphy

(10) Patent No.: US 7,886,874 B2
(45) Date of Patent: Feb. 15, 2011

(54) WHEEL FLANGE LUBRICATING DEVICE

(75) Inventor: Wayne H. Murphy, Pottstown, PA (US)

(73) Assignee: Pennsy Corporation, West Chester, PA (US)

( * ) Notice: Subject to any disclaimer, the term of this patent is extended or adjusted under 35 U.S.C. 154(b) by 1258 days.

(21) Appl. No.: 11/183,449

(22) Filed: Jul. 18, 2005

(65) Prior Publication Data

US 2007/0012515 A1 Jan. 18, 2007

(51) Int. Cl.
*B61K 3/00* (2006.01)

(52) U.S. Cl. ..... 184/3.2; 184/99

(58) Field of Classification Search ..... 184/3.1–3.3, 184/99, 98, 6.4, 15.1
See application file for complete search history.

(56) References Cited

U.S. PATENT DOCUMENTS

| | | | | |
|---|---|---|---|---|
| 332,994 | A | 12/1885 | Clarkson | |
| 934,425 | A | 9/1909 | Callahan | |
| 990,034 | A | 4/1911 | Conniff | |
| 990,637 | A | 4/1911 | Dawson | |
| 1,017,015 | A | 2/1912 | Perkins | |
| 1,025,916 | A | 5/1912 | Kincaid | |
| 1,027,559 | A | 5/1912 | Miner | |
| 1,033,919 | A | 7/1912 | Miner | |
| 1,043,141 | A | 11/1912 | Plymale | |
| 1,092,738 | A | 4/1914 | Miner | |
| 1,152,593 | A | 9/1915 | Black | |
| 1,196,509 | A | 8/1916 | Black | |
| 1,222,341 | A | 4/1917 | Wholey | |
| 1,279,345 | A | 9/1918 | Hoofer | |
| 1,438,026 | A | 12/1922 | Eichelberger | |
| 1,503,174 | A | 7/1924 | Vincent | |
| 1,753,410 | A | 4/1930 | Grismore | |
| 1,780,464 | A | 11/1930 | Coppage | |
| 1,972,371 | A | 9/1934 | Bonnifield | 184/3 |
| 2,489,442 | A | 11/1949 | Whiting | 184/3 |
| 2,550,865 | A | 5/1951 | Ross et al. | 184/3 |
| 2,580,687 | A | 1/1952 | McMillan | 184/3 |
| 2,589,582 | A | 3/1952 | Strughold et al. | 252/12 |
| 2,637,411 | A | 5/1953 | Harbison | 184/3 |
| 2,727,589 | A | 12/1955 | Campney | 184/3 |
| 2,800,198 | A | 7/1957 | Jones et al. | 184/3 |
| 2,866,521 | A | 12/1958 | Gibson | 184/3 |
| 2,903,090 | A | 9/1959 | Brown et al. | 184/3 |
| 2,946,404 | A | 7/1960 | O'Neal | 184/3 |
| 3,944,025 | A | 3/1976 | Owen | 184/3 |
| 4,088,078 | A | 5/1978 | Noble | 104/26 A |
| 4,485,898 | A | 12/1984 | Bracken et al. | 188/250 B |
| 4,711,320 | A | 12/1987 | Dombroski et al. | 184/3.2 |

(Continued)

*Primary Examiner*—Bradley T King
*Assistant Examiner*—James K Hsiao
(74) *Attorney, Agent, or Firm*—John F. A. Earley, III; Frank J. Bonini, Jr.; Harding, Earley, Follmer & Frailey, P.C.

(57) ABSTRACT

A lubricator for the wheel flanges of railway vehicle wheels comprises an arm carrying a lubricating pad and a mounting element formed integrally with the arm. The mounting element fits into the entrance of the key slot in the brake beam head beside the brake retainer key. The key head fits in a groove in the top of the mounting element to retain the lubricator in place. When the lubricant is exhausted, the key is partially withdrawn to allow removal of the mounting element and the lubricator is replaced. When partially withdrawn, the key still retains the show on the brake beam head.

17 Claims, 4 Drawing Sheets

U.S. PATENT DOCUMENTS

| | | | | | |
|---|---|---|---|---|---|
| 4,763,759 | A | | 8/1988 | Federico | 184/3.2 |
| 4,915,195 | A | * | 4/1990 | Dial | 184/3.2 |
| 5,085,292 | A | * | 2/1992 | Dial | 184/3.2 |
| 5,251,724 | A | | 10/1993 | Szatkowski et al. | 184/3.2 |
| 5,305,853 | A | | 4/1994 | Ross et al. | 184/3.2 |
| 5,337,860 | A | * | 8/1994 | Burke et al. | 184/3.2 |
| 5,358,072 | A | | 10/1994 | Szatkowski et al. | 184/3.2 |
| 5,415,896 | A | | 5/1995 | Mulvihill et al. | 427/388.4 |
| 5,477,941 | A | | 12/1995 | Kumar et al. | 184/3.2 |
| 5,518,085 | A | | 5/1996 | Houser, Jr. et al. | 184/3.1 |
| 6,182,793 | B1 | | 2/2001 | Jamison | 184/3.2 |
| 6,769,519 | B2 | | 8/2004 | Velayutha | 188/264 B |
| 2002/0020793 | A1 | * | 2/2002 | Chalmers | 248/279.1 |
| 2003/0101897 | A1 | * | 6/2003 | Mitrovich et al. | 104/279 |

* cited by examiner

WHEEL FLANGE LUBRICATING DEVICE

FIELD OF THE INVENTION

This invention is directed particularly to rail car vehicles, including cars and locomotives, and more particularly to devices for lubricating the rail contact region of the flanges of wheels of such vehicles.

BACKGROUND OF THE INVENTION AND PRIOR ART

Problems of wheel and rail wear caused by friction generated particularly from contact of the flanges with the rails on curves and the tendency of the wheels of rail car vehicles to hunt on tangent track, whereby the flanges of the car wheels alternately bear against one rail and then the other as the car travels along the track have been recognized for many years. Over a century or more, a large number of solutions have been proposed, some of which have been put into use. These have ranged from stationary track lubricators for directly applying lubricant to the rails at selected locations to reservoirs of a liquid lubricant mounted on the rail vehicle for application of liquid lubricant directly on the vehicle wheels. More recent lubrication devices, as illustrated in U.S. Pat. Nos. 4,915,195 and 5,085,292, apply oil or other lubricant by use of lubricant-containing porous polymeric members mounted for engagement with the flanges of the wheels of rail cars. Despite the teachings of a large body of prior art of which the above is exemplary, the need still exists for a simple, inexpensive, disposable device capable of use for at least the duration of standard car maintenance cycles including the rather long intervals for inspection and maintenance of cars in extended or long haul service.

SUMMARY OF THE INVENTION

The invention consists of a lubrication device for lubrication of the rail contact area of the flange of a wheel of a rail car or like vehicle. The invention is particularly adapted to cars having trucks carrying pairs of wheel sets and a brake system including a standard brake beam head and a brake shoe mounted on the beam head. The beam head is movable upon application of a brake control device to move the brake pads against the wheels. As is conventional practice, a brake key is extended through passages or channel in the brake beam head and the brake shoe which are in alignment when the brake shoe is supported on the beam head to lock the brake shoe to the beam head. The lubrication device of the present invention comprises a mounting plug and an integrally connected arm with supports which fits within the entrance to the key passage or channel in the brake beam head. The mounting plug is held in place by the brake key when the brake key is inserted into said passage or channel portion and advanced to the position in which the brake shoe is locked in place. The lubrication device further comprises an arm extending in the lengthwise direction of the railway vehicle. The proximal end of the arm is integrally joined to the mounting plug. The arm extends towards a wheel of the rail car vehicle and supports a lubricant pad containing a solid lubricant for lubrication of the flange of the adjacent wheel.

In preferred form, the lubrication device comprises an integrally formed one piece arm and mounting plug formed from a moldable plastic resin by an injection molding or a similar process. The device is simple and inexpensive, is resilient yet durable in construction and may be disposed of when the supply of lubricant is exhausted. It is installed and removable without the need to separate the brake shoe from the beam head.

DETAILED DESCRIPTION OF THE PREFERRED EMBODIMENT

Figure 1:
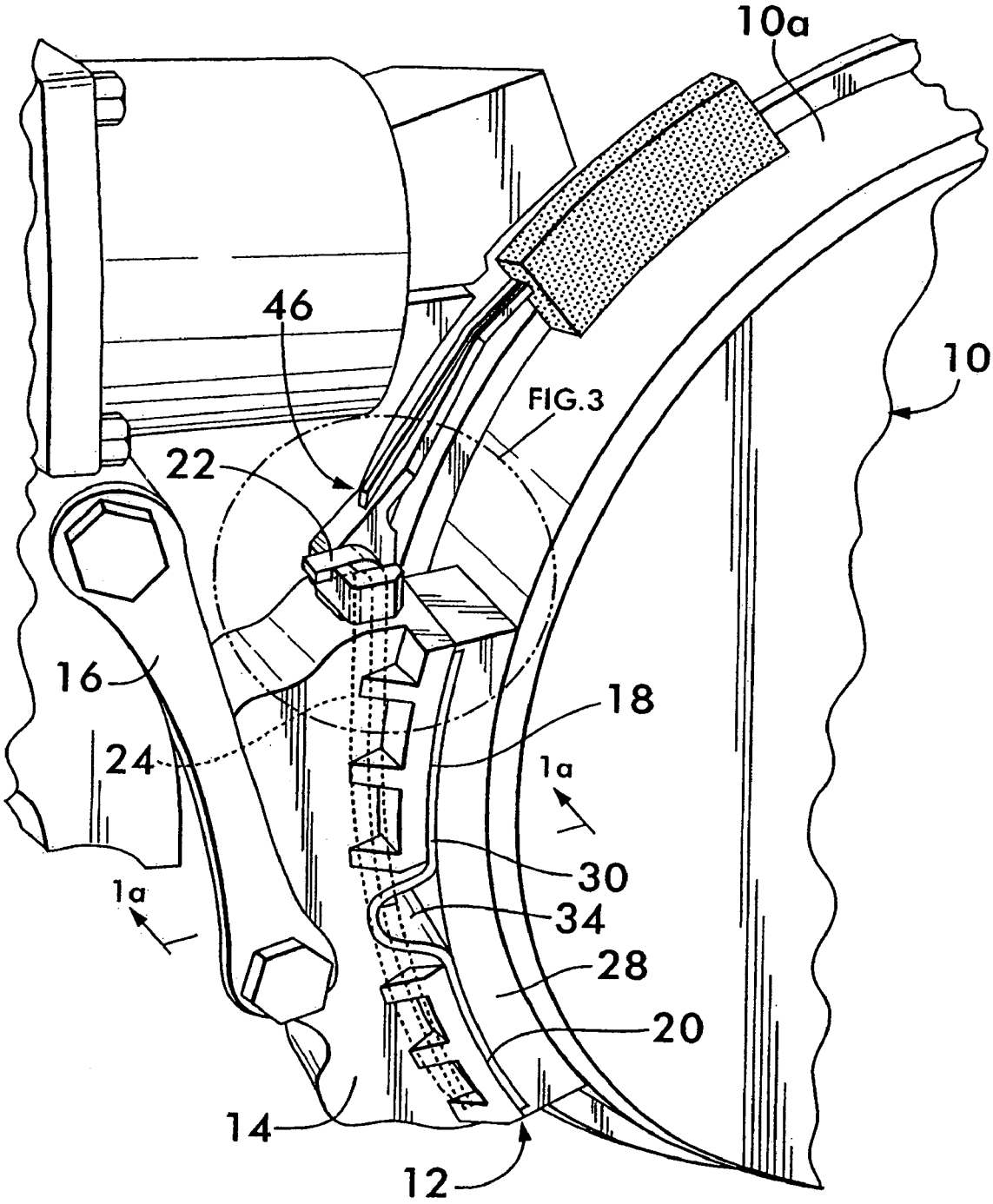
FIG. 1 is an elevational view of a portion of a rail car illustrating the use of the present invention.

FIG. 1 illustrates one wheel 10 of a conventional freight car truck with a brake shoe 12 mounted on a brake beam head 14 suspended from the truck by a link 16. The brake shoe 12 is movable from a position spaced away from wheel tread 10*a* to the position shown which the shoe is in contact with the wheel tread, whereby braking force is applied to slow or stop the rail car.

Figure 1A:
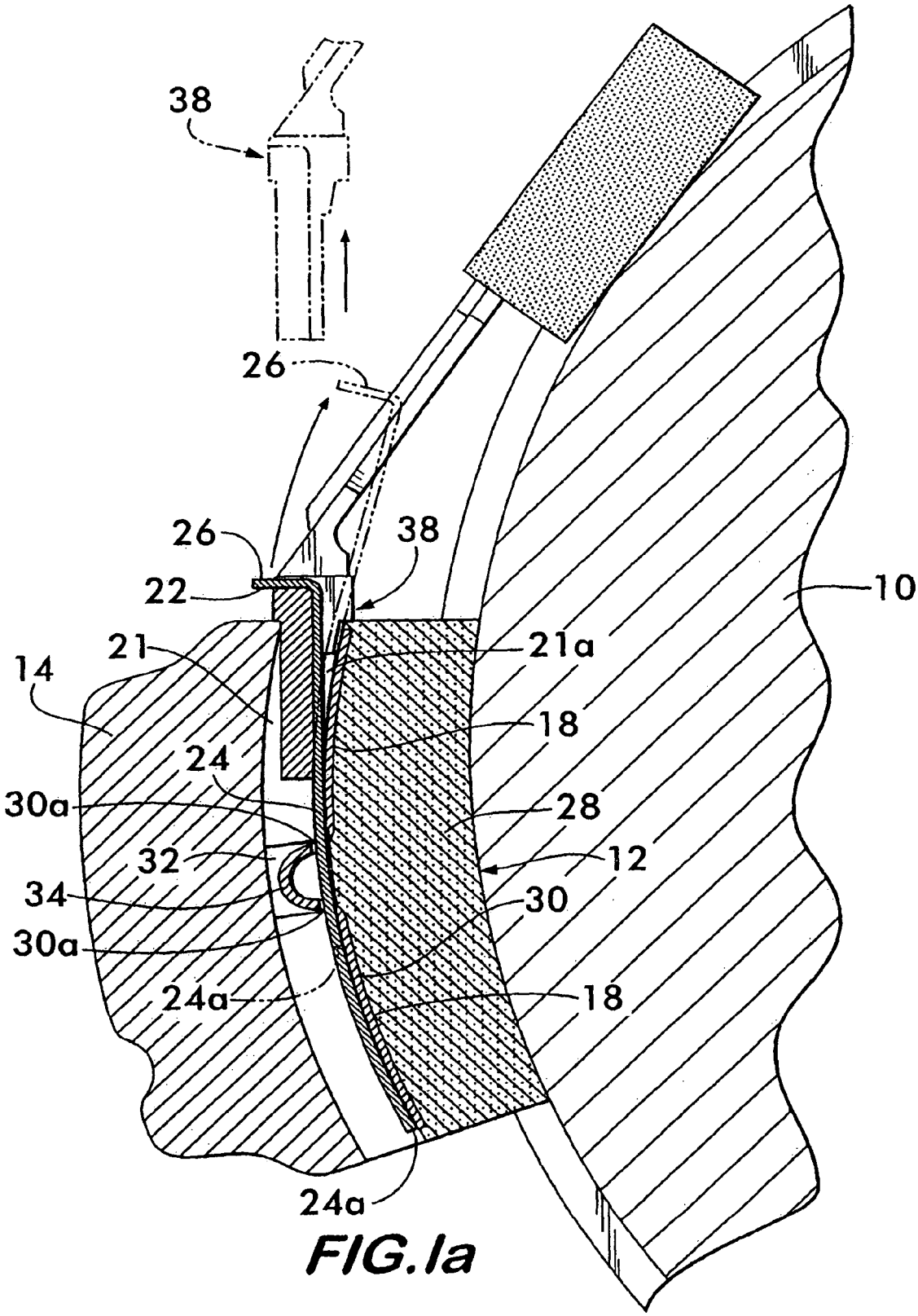
FIG. 1*a* is a schematic view in section of a conventional brake beam head and brake pad illustrating the means of attachment of the pad to the head.

Referring also to FIGS. 1*a*-3, brake beam head 14 is provided with arcuately-shaped surfaces 18 and 20 upon which the brake shoe 12 is supported. As shown in FIG. 1*a*, the brake beam head 14 is provided with a longitudinally extending passage or channel 21 spaced behind surfaces 18 and 20 having an entrance end 21*a* through which a key 22 having a shank 24 conforming to the curvature of the channel is inserted. The brake key has a turned over head 26. The brake shoe 12 comprises a brake pad 28 and a backing plate 30 for support on arcuate surfaces 18 and 20 on the brake beam head 14. A recess 32 on the brake beam head 14 is located midway between surfaces 18 and 20 and extends through passage or channel 21 and receives a retainer bracket 34 which is typically integrally formed as part of backing plate 30. The retainer bracket 34 has a pair of apertures 30*a* which are positioned for alignment with the passage or channel 21, whereby the brake pad 28 is locked to the brake beam head 14 when the key shank is advanced through the passage or channel 21 as is conventional practice in the art. In the advanced position of the key, its tip 24*a* extends substantially to the lowermost end of passage or channel 21.

Figure 4:
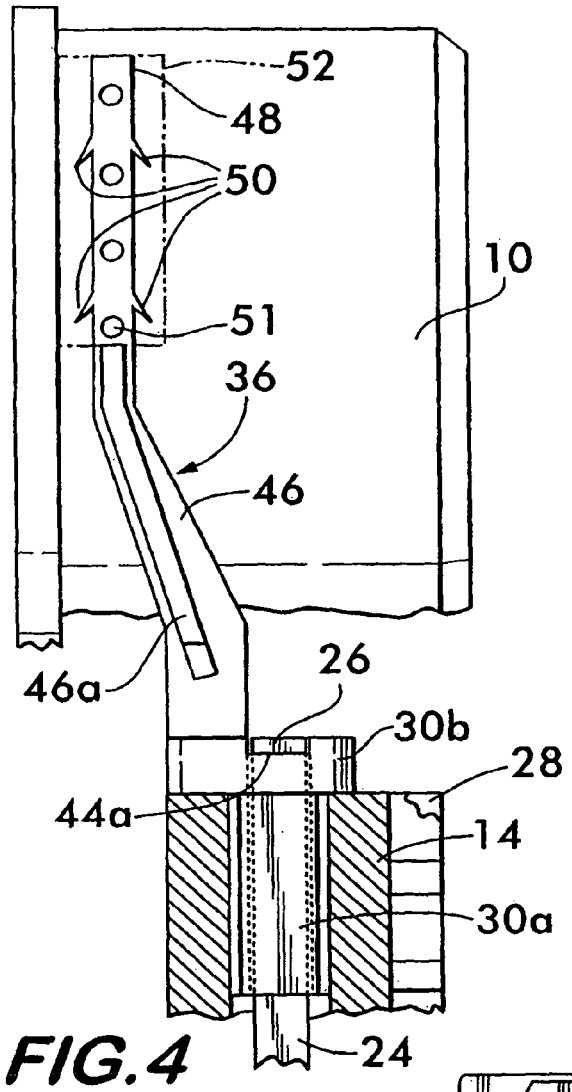
FIG. 4 is a plan view of the arm and mounting plug.
Figure 4B:
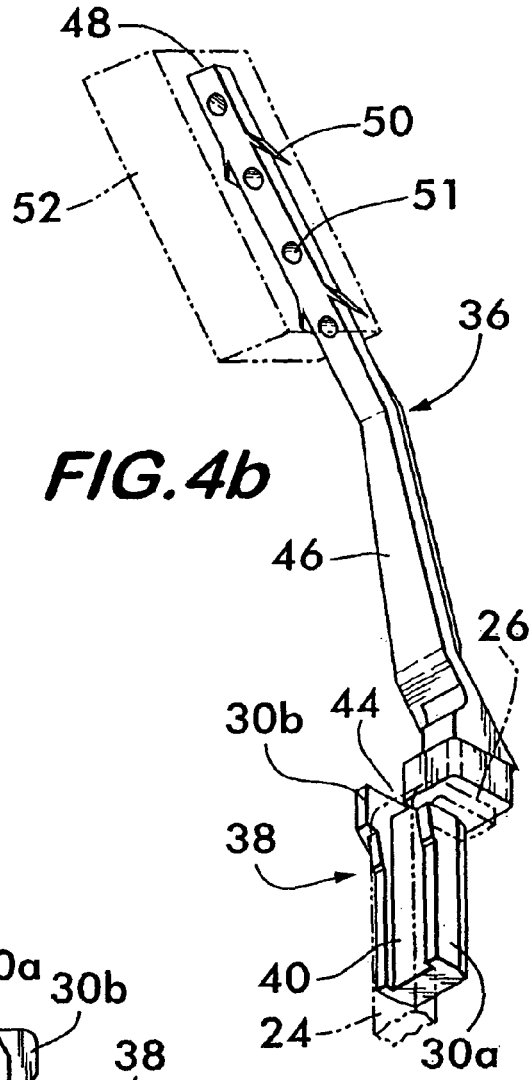
FIG. 4*b* is a perspective view of the arm and mounting plug of FIGS. 4 and 4*a*.
Figure 4A:
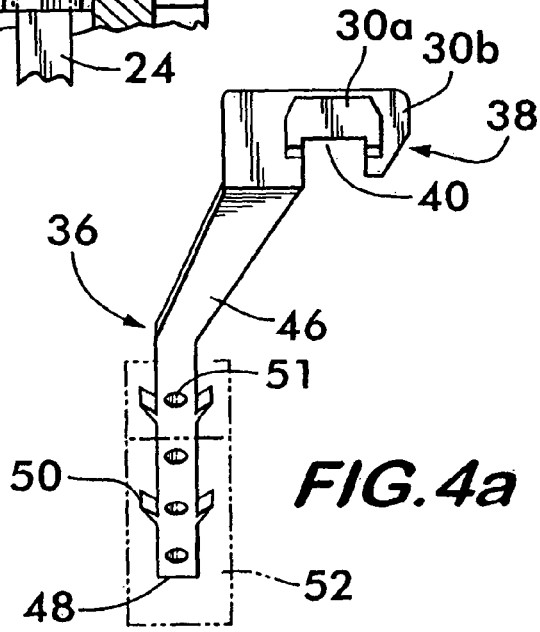
FIG. 4*a* is an end view looking in the direction of arrow X in FIG. 4.

In its preferred form, as illustrated in FIGS. 4-4*b*, the lubrication device 36 includes a mounting plug 38 with an elongated shank 38*a* which is sized to fit within the entrance 21*a* of channel 21 of the brake beam head. The plug element has a groove 40 which extends lengthwise of shank 38*a* and enlarged head portion 38*b*, as best seen in FIGS. 4 and 4B. The groove 40 is dimensioned to receive the key shank 24 within the entrance to the elongated channel 21. When the key is fully inserted, the key head 26 seats on a recessed surface 44*a* on head portion 38*b* and the head portion seats on the surface surrounding the entrance 21*a* to passage or channel 21, as can be best seen in FIG. 3, thereby retaining the plug element firmly in place.

An arm 46 is preferably formed integrally with the connecting plug element 38 as by injection molding. The arm is shaped to project angularly away from the connecting plug element 38 and has an end section 48 angularly directed from the arm 46 in a direction generally in the plane of rotation of wheel 10. The arm may be provided with a stiffening rib 46*a*. End section 48 preferably has a plurality of barbs 50 and holes 51 provided for the purpose of retaining a pad 52 formed of a polymeric material containing lubricant and/or a friction modifier. Presently preferred is a lubricant pad material as is available from Phymet, Inc. of Springboro, Ohio 45066, which comprises a mixture of polymers and oils to create a solid lubricant with an oil filled porous structure wherein the oil is slowly diffused by capillary action. An acceptable alternative is a solid polymer lubricant available from MPL Technology of Kenmore, Wash.

Figure 2:
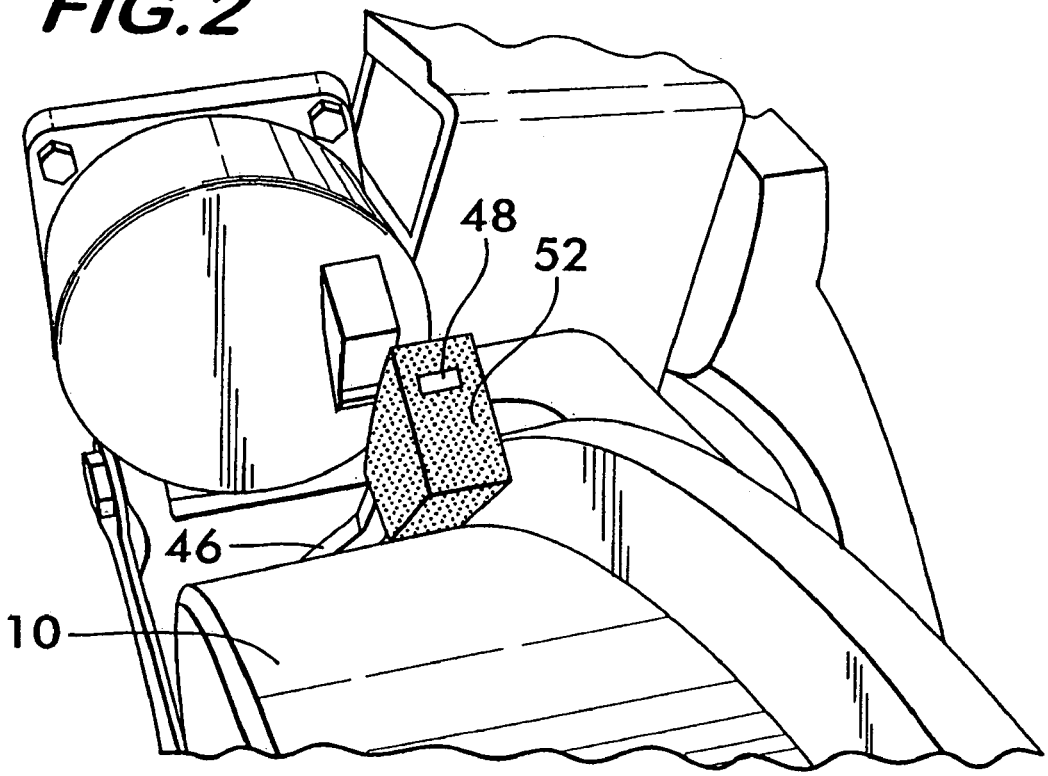
FIG. 2 is an end view in perspective illustrating the position of the lubricant pad relative to the rail car wheel.
Figure 3:
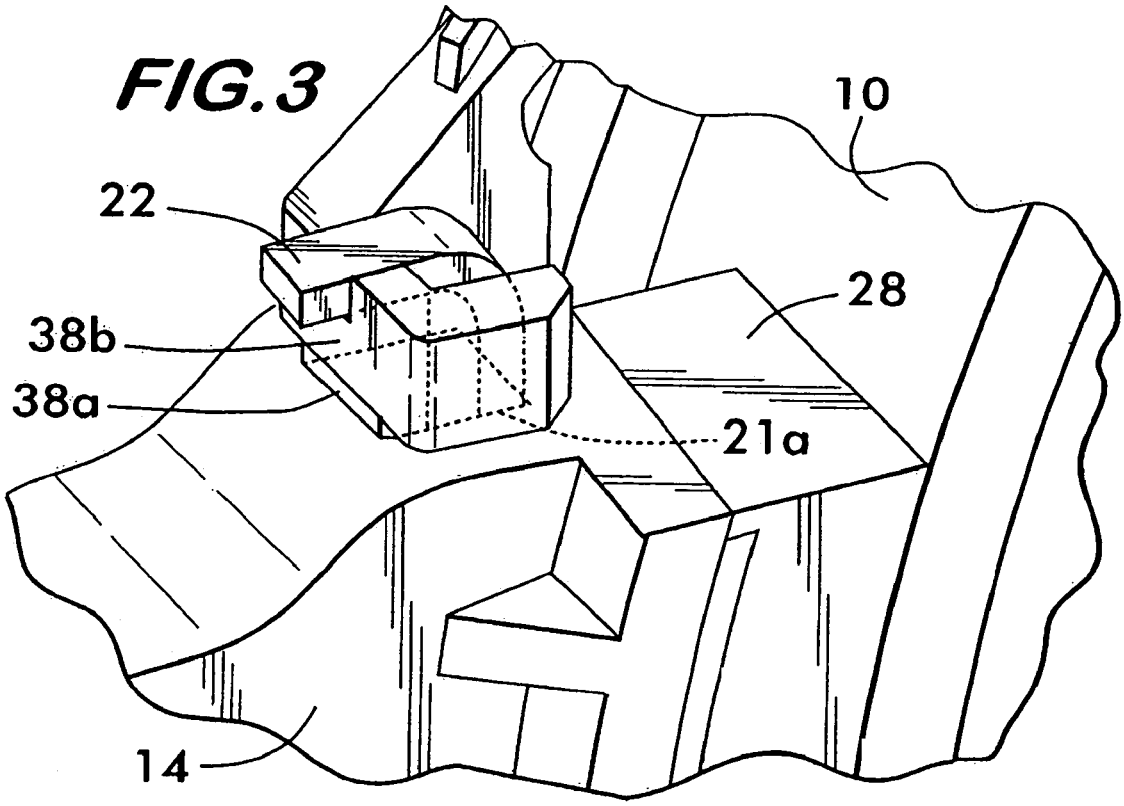
FIG. 3 is a fragmentary view on an enlarged scale with respect to FIG. 1 illustrating the positioning of the lubrication device mounting plug as inserted in the brake beam head key slot.

In the preferred embodiment of the invention, lubrication device 36 is intended to be disposable. It is preferably molded as a one piece integrally formed member including mounting plug element 38, arm 46 and end section 48 by injection molding or the like and is formed of a polymeric material, such as urethane or nylon, urethane being the presently preferred material. As can be seen in FIGS. 1 and 2, the lubricant-containing pad 52 is preferably of rectangular cross-section and mounted on the end section 48 of arm 46 for relative positioning so as to bear against flange 10*a* of wheel 10, as well as the region of the tread which joins the flange. The arm 46 should possess sufficient resilience so as to cause the lubricant-filled pad 52 to bear against the flange 10*a* and exude lubricant throughout the interval between car inspections. The resilience of arm 46 maintains the pad 52 against the flange whether or not the brake pad 28 is retracted from the wheel or bearing against it. The stiffness of arm 46 will depend upon the degree to which the lubricant is exuded from pad 52.

As indicated, the lubrication device 36 is intended to be a disposable item having a lubrication capacity sufficient to maintain the wheel 10 lubricated for the duration of standard brake shoe life. To replace a spent lubrication device, the key 22 is retracted sufficiently from the channel in the brake beam head 14 to allow the mounting plug element 38 to be removed and the plug element of a new lubrication device to be inserted in the entrance to channel 21. When withdrawn this far, the key shank 24 will still extend through the retainer bracket 34 and into the end part of passage or channel 21 so that the brake pad 28 will be retained on the brake beam head 14, thereby avoiding the time-consuming need to reinstall the brake pad whenever the lubrication device 36 is replaced.

What is claimed is:

1. A lubrication device for lubrication of the contact area of the flange of a railway vehicle wheel, wherein the railway vehicle includes a brake system having a brake beam head, said brake beam head being configured to providing a support surface for receiving a brake shoe in supporting relation thereto, said brake beam head having first and second key receiving channel portions underlying said support surface and having an entrance end for insertion of a key having an elongated shank for locking said brake shoe to said support surface, said brake shoe including a retainer bracket positioned between said, first and second channel portions and having openings positioned to retain a key advanced through said first and second channel portions when said brake shoe is positioned in said support surface, a key having an elongated shank for insertion through said first and second channel portions and the openings of said retainer bracket to lock said brake shoe to said brake beam head, said lubrication device comprising an arm projecting towards the flange of said wheel and having a distal end having a lubricant pad affixed thereto for engagement with the wheel flange and a proximal end having a mounting connector for securing said arm to said brake beam head, said mounting connector having an elongated body configured to fit within the entrance to said first channel portion in side-by-side relation to the shank of said key;

wherein the device is configured so that the key that locks the brake shoe to the support surface may be withdrawn from the first channel portion to release said mounting connector while still retaining the brake shoe on said brake beam head.

2. A lubrication device according to claim 1, said key having a head at one end including a portion projecting laterally from the shank, said mounting connector having a surface positioned to interface with the laterally projecting head portion when the shank is inserted through said channel portions, said mounting connector being captured by the head when the key shank is advanced through the first and second channel portions.

3. A lubrication device according to claim 2, wherein the elongated body portion of said mounting connector includes a groove extending lengthwise thereof for receiving said key shank.

4. A lubrication device according to claim 3, wherein mounting connector further includes a head portion configured to overlap the edge surfaces surrounding the entrance to said key receiving channel portions, whereby the mounting connector seats on said edge surfaces, said head portion further having a recess for receiving the head of the key when the key is positioned within said channel portions.

5. A lubrication device according to claim 2, wherein said surfaces interfacing with said laterally projecting head portion of said keys comprises a recess within which said head interfits.

6. A lubrication device according to claim 2, wherein the key shank is relatively dimensioned to remain within the second channel portion when the key shank is withdrawn a sufficient distance to allow for insertion of said mounting connector.

7. A lubrication device according to claim 2, wherein the arm and the mounting connector are integrally connected.

8. A lubrication device according to claim 7, wherein the arm and the mounting connector are formed of a polymeric material.

9. A lubrication device for lubrication of the rail contact area of a railway vehicle wheel including a support positioned in adjacent relation to the wheel and a passage in said support, said passage having an entrance for insertion of a retainer key having an elongated shank that is configured to retain one or more brake components, said lubrication device comprising a flexible resilient arm, a mounting connector integrally supporting said arm and a lubricant-containing pad on said arm disposed oppositely to said mounting connector, said mounting connector being configured to interfit within the entrance to said passage alongside said retainer key and to position said arm towards the railway vehicle wheel with the pad yieldably maintained in a position of contact with the wheel flange;

wherein said lubrication device is configured to be removable from said support independently of said one or more brake components.

10. A lubrication device according to claim 9, further comprising an integrally elongated attached support for said pad at the end of said arm opposite to said mounting connector.

11. A lubrication device according to claim 10, further including attachment barbs on said support for retaining said lubrication pad.

12. A lubrication device according to claim 11, wherein said arm is formed of a polymeric material.

13. A lubrication device according to claim 10, wherein said arm is angularly disposed relative to said passage.

14. A lubrication device according to claim 9, said key having a head having a laterally extending portion movable into a position of interengagement with the mounting connector for retaining the mounting connector within the passage entrance.

15. A lubrication device according to claim 9, wherein said support includes a support surface for support of a brake shoe, said passage extending lengthwise of said support surface, a recess in said support surface intersecting said passage, said brake shoe including a brake pad and a support plate seated on said support surface and a retainer interfitting within said recess, said retainer having spaced openings for receiving said key when the key is inserted through said passage, said key being movable a fixed distance to a release position in which said mounting connector is freely removable from the passage entrance independently of the removal of said brake shoe, said key being dimensioned to be received within the openings in the retainer when moved to said release position.

16. A lubrication device for lubrication of the contact area of the flange of a railway vehicle wheel, wherein the railway vehicle includes a brake system having a brake beam head, said brake beam head being configured to providing a support surface for receiving a brake shoe in supporting relation thereto, said brake beam head having first and second key receiving channel portions underlying said support surface and having an entrance end for insertion of a key having an elongated shank for locking said brake shoe to said support surface, said brake shoe including a retainer bracket positioned between said first and second channel portions and having openings positioned to retain a key advanced through said first and second channel portions when said brake shoe is positioned in said support surface, a key having an elongated shank for insertion through said first and second channel portions and the openings of said retainer bracket to lock said brake shoe to said brake beam head, said lubrication device comprising an arm projecting towards the flange of said wheel and having a distal end having a lubricant pad affixed thereto for engagement with the wheel flange and a proximal end having a mounting connector for securing said arm to said brake beam head, said mounting connector having an elongated body configured to fit within the entrance to said first channel portion in side-by-side relation to the shank of said key;

wherein said key is retractable within said channel to a position that releases said lubrication device from said brake beam head while continuing to retain said brake shoe.

17. A lubrication device for lubrication of the rail contact area of a railway vehicle wheel including a support positioned in adjacent relation to the wheel and a passage in said support, said passage having an entrance for insertion of a retainer key having an elongated shank that is configured to retain one or more brake components, said lubrication device comprising a flexible resilient arm, a mounting connector integrally supporting said arm and a lubricant-containing pad on said arm disposed oppositely to said mounting connector, said mounting connector being configured to interfit within the entrance to said passage alongside said retainer key and to position said arm towards the railway vehicle wheel with the pad yieldably maintained in a position of contact with the wheel flange;

wherein said lubrication device mounting connector is independently removable from said passage relative to the removal of said one or more brake components that are retained by said elongated shank of said key.

* * * * *